US005298335A

United States Patent [19]

Reed et al.

[11] Patent Number: 5,298,335

[45] Date of Patent: Mar. 29, 1994

[54] METHOD FOR MAKING COATED PAPER AND A PAPER COATING COMPOSITION

[75] Inventors: W. Michael Reed, York; Jan E. Smith, Greenville, both of Pa.

[73] Assignee: P. H. Glatfelter Company, Spring Grove, Pa.

[21] Appl. No.: 936,308

[22] Filed: Aug. 28, 1992

[51] Int. Cl.[5] ..... B32B 23/08; B32B 27/10

[52] U.S. Cl. ..... 428/511; 427/391; 428/513; 428/514

[58] Field of Search ..... 427/391; 428/511, 513, 428/514

[56] References Cited

U.S. PATENT DOCUMENTS

| | | | |
|---|---|---|---|
| 3,260,690 | 7/1966 | Bohnert et al. | 260/29.7 |
| 3,477,862 | 4/1969 | Forsyth | 106/22 |
| 3,674,632 | 7/1972 | Wennergren et al. | 162/168 |
| 3,892,675 | 7/1975 | Clarke et al. | 252/301.3 W |
| 4,014,833 | 3/1977 | Story | 260/29.2 EP |
| 4,169,823 | 10/1979 | Jones | 260/29.6 NR |
| 4,241,143 | 12/1980 | Ashie et al. | 428/512 |
| 4,305,781 | 12/1981 | Langley et al. | 162/164 |
| 4,341,597 | 7/1982 | Andersson et al. | 162/127 |
| 4,477,495 | 10/1984 | Ring et al. | 467/365 X |
| 4,820,380 | 4/1989 | O'Callaghan et al. | 162/135 |
| 4,927,495 | 5/1990 | Tamagawa | 162/135 |
| 5,108,782 | 4/1992 | Reed | 427/54.1 |

OTHER PUBLICATIONS

Kirk-Othmer, *Encyclopedia of Chemical Technology*, 3rd Ed., vol. 18, "Plant-Growth Substance to Potassium Compounds", pp. 627-629 (1982).

Billmeyer, Fred W. Jr., *Textbook of Polymer Science*, 3rd Ed. 1984, pp. 157-159.

*Primary Examiner*—Michael Lusignan

*Attorney, Agent, or Firm*—Fisher, Christen & Sabol

[57] ABSTRACT

A coating for paper comprising water, pigments, binder and poly(ethylene oxide). The binder comprising about 1 to 30 percent by weight of the dry weight of the pigments and the poly(ethylene oxide) comprising about 0.001 to 10 percent by weight of the dry weight of the pigments. The coating has a very low Brookfield viscosity. The poly(ethylene oxide) coating provides superior gloss and smoothness relative to conventional paper coatings and may be applied to the paper in higher coat weights. A process for using the poly(ethylene oxide) coating to make improved paper is also disclosed.

13 Claims, No Drawings

METHOD FOR MAKING COATED PAPER AND A PAPER COATING COMPOSITION

BACKGROUND OF THE INVENTION (a) Field of the Invention

The present invention is directed to coating compositions for substrates such as paper and paperboard. More particularly, the invention relates to a coating composition containing poly(ethylene oxide) and an improved method for applying higher coating weights at standard coating operating conditions than would normally be obtainable. An improved coated paper is also provided.

(b) Related Art

Aqueous pigmented coatings are generally applied to paper to provide a superior surface for printing and other converting applications. These coatings are made up of pigments as the main ingredient with binders and various additives, which give the paper a fairly uniform surface on which printing ink can be applied. The desirable properties of the finished paper include gloss, fiber coverage, surface smoothness, and overall sheet appearance.

An integral part of any coating, whether it be for printing or another specialty application, is the rheology modifier. The rheology modifier imparts low and high shear viscosity properties to allow application to paper by high speed blade and bar coaters. The rheology modifier is critical in providing uniform application at the desired coating coverage rate. In choosing a rheology modifier, one must take into account possible side effects that may produce undesirable coated paper properties. These additives tend to affect drying rate, gloss, smoothness and porosity. Common rheology modifiers include cellulosic derivatives, polyacrylates, modified starches, and alginates. For example, U.S. Pat. No. 4,341,597 to Andersson et al. ("Andersson") discloses a fibrous material having good dimensional and heat stability—Andersson teaches a coating (e.g., for paper) utilizing polyoxyalkylene. No particular gloss or coat weight benefits are alleged.

Poly(ethylene oxide) has been included in other coating compositions. For example, U.S. Pat. No. 3,892,675 to Clarke et al. ("Clarke et al.") discloses coating compositions with improved whiteness and fastness to light. Clarke et al. discloses coating compositions comprising white pigment extender, polyvinyl acetate latex as the sole binding agent, one or more sparingly water-soluble optical brightening agents in finely-divided form and water. The white pigment extender preferably comprises from 30 to 70% by weight of the coating composition. The optical brightening agent preferably comprises from 0.01 to 0.25% of the weight of the white pigment extender.

As noted in column two, lines 53–63, the coating composition may also include an "assistant" such as polyethylene oxide (or alkyl ether thereof, copolymers of ethylene and propylene oxides, polyvinyl-alcohol, polyvinyl pyrrolidone, and water-soluble condensation products of formaldehyde with urea or melamine). The assistant preferably comprises from 0.002 to 5% of the pigment extender by weight. As discussed in column 3, lines 5–20, Clarke et al. alleges that the coating compositions provide superior whiteness to paper coated therewith. Clarke et al. alleges that the coating compositions may be applied to the paper by conventional means (e.g., air-knife, blade, brush, roller or bar coating techniques). Clarke et al. do not appear to make any allegations about improved gloss through the use of their coatings. Also, Clarke et al. do not appear to disclose any particular molecular weight for their polyethylene oxide.

U.S. Pat. No. 4,169,823 to Jones ("Jones") discloses a coating composition comprising an aqueous emulsion of polyethylene containing a water-soluble polyethylene oxide. Jones teaches the use of a coating composition comprising an aqueous emulsion of a polyethylene (e.g., having an average molecular weight of about 1200 to about 2000), said polyethylene emulsion containing from about 0.5% to about 15% (by weight of the polyethylene emulsion) water-soluble polyethylene oxide. The polyethylene oxide ranges in molecular weight from about 100,000 to about 1,000,000 (col. 3, lines 11–22). The polyethylene oxide-containing polyethylene emulsion may be applied to the substrate (e.g., paper) by conventional means such as dipping, spraying, knife coating, roller coating, air coating, extrusion coating, etc.

Jones alleges that the polyethylene-polyethylene oxide coating provides paper with superior dusting and scuff resistance properties (i.e., relative to conventional coatings—e.g., colloidal silica—see, Table A). No particular improvements in gloss properties of the paper are alleged.

U.S. Pat. No. 5,108,782 to Reed ("Reed") discloses a silicone release coating. Reed teaches a silicone release coating emulsion comprising a reactive crosslinkable silicone, a catalyst and a high molecular weight, water soluble or water dispersible polymeric thickening agent such as polyethylene oxide. The polymeric thickening agent has a molecular weight greater than about 100,000 g/mole Mw. The silicone release emulsion is applied as a coating to a substrate, and particularly paper, and cured to form a release coating for pressure sensitive adhesives. The silicone emulsion exhibits improved holdout of the silicone from the substrate. Reed does disclose (in Table 1) improved paper gloss values with PEO coatings. Nevertheless, Reed does not appear to disclose improved (i.e., higher) coat weights per run through the coating machine.

Until the present invention, it was not known that by using PEO (Poly(ethylene oxide)) it is possible to apply higher coating weights than previously were obtainable with standard coater operating conditions. Likewise, standard coating weights have been hereby found to be obtainable under modified coater operating conditions. This is also beneficial since many specialty coatings can only be run with modified operating conditions. Using PEO as the rheology modifier allows for standard coating weights to be obtained under these modified conditions.

Furthermore, using PEO in the coating formulation, it has been found possible to achieve high coat weights with coatings that have viscosity values that would traditionally be considered too low for high speed coating. Many specialty coating applications require specific surface properties and/or surface chemistry. Laboratory draw downs and bench coating work can be utilized to define the necessary properties for the application in question. However, in order to apply the formulated coating on high speed and high shear coating equipment, a thickener or rheology additive must be included in the formulation. The purpose of the thickener is to raise the high shear and low shear viscosities to a level that will allow for high coat weight application. Typical Brookfield Viscosity might be in the range of 2000 cps. to 5000 cps. Even higher viscosities might be needed for ultra high coat weights (e.g., 10–20 lbs./3300 $ft^2$).

Unfortunately, the amount of traditional thickener required to achieve ultra high coat weights often changes the surface properties and/or chemistry of the coated sheet. An alternative to using high levels of thickener is to double coat the sheet (two or more coatings on the same side) to achieve the desired paper surface. This can be done with two passes through an off machine coater, with a multi-station coater, or with a precoat applied on the paper machine followed by a single pass through a coater. Each of these methods add additional cost to the coated grade, however.

PEO has been found to provide a coating tool that allows unusually high coating weights to be obtained at very low addition levels of thickener. This insures that a higher percentage of binder/pigment is available on the paper surface for the end use application. Also, this allows the desired paper properties to be obtained with a single coating pass.

SUMMARY OF THE INVENTION

The present invention is directed to a method for solving the above-noted problems and suboptimizations and improving the surface properties of coated papers by applying high coating weights (10–20 pounds per ream hereinafter—"#/rm") with a single coating pass. Poly(ethylene oxide) (hereinafter "PEO") is utilized as a rheology modifier at relatively low levels to impart a unique rheology to the coating formulation. This allows the application of conventional coating formulations at unusually high levels of coating weight on conventional high shear coating equipment.

The invention is further directed to a method for improving the gloss of a coated paper by addition of PEO to a pigmented coating either as the sole rheology modifier or in combinations with other rheology modifiers.

Another object of the invention is to provide a composition and process for applying a coating with improved surface properties such as smoothness, fiber coverage, and gloss using standard coating technology in combination with the rheological control additive—PEO.

DETAILED DESCRIPTION OF THE PREFERRED EMBODIMENTS

Generally speaking, the inventive coating comprises a mixture of poly(ethylene oxide)—PEO, pigment, binder and water. Depending upon the desired characteristics of the coating composition, 0.001–10 dry percent of PEO and 1–30 dry percent of binder, based on the weight of the pigment is used. More preferably, the PEO comprises 1% or less by weight of the weight of the pigment by dry weight and most preferably the PEO comprises 0.001 to 0.2% by weight of the weight of the pigment dry weight. Other additives may also be utilized in the coating composition such as insolubilizers, crosslinkers, lubricants, and dyes without any adverse effects on the composition. Clays (e.g., kaolin, etc.) are preferably used as the pigment. Synthetic pigments may also be used (e.g., the Styrene-Acrylic-based pigment sold by the Rohm & Haas Company under the name "OP-84"). Furthermore, synthetic and natural pigments may be blended within a particular coating and pigments of varying particle sizes, roundnesses, etc. may be used without detrimentally affecting the coating.

Sufficient water should be incorporated within the inventive coating to insure appropriate functionality. It has been found that the present coating works well at solids concentrations reasonably typical of other (i.e., non-PEO based) coatings—i.e., about 60 percent solids (± about 3%).

In other coating formulations (e.g., for use with release coatings), 0.01–20 dry percent PEO (based on the total weight of the binder used) is added to a non-pigmented coating. Other additives may also be utilized in the non-pigmented coating composition such as insolubilizers, crosslinkers, lubricants, and dyes without any adverse affects on the composition.

A wide variety of binders may be used in the present coating invention. Both synthetic (e.g., styrene butadiene rubber—"SBR"—e.g., sold under the tradename "DOW 620" by the Dow Chemical Company; vinyl acetate—e.g., sold under the tradename "VINAC 884" by the Air Products Corp.; and/or vinyl acrylics) and natural binders (e.g., starches, proteins, etc.) may be used. Mixtures of synthetic and natural binders may also be used. Preferably, a wholly natural binder is avoided, but it has been found that a wide variety of binders and combinations of binders may be used without modification of the concentrations or processing conditions of the other components. It has been noted that many commercially-available binders have a solids content of 40–50%—this range has proven to work well in the inventive coating composition.

The preferred thickening agent is a linear aliphatic polymer having a molecular weight of at least about 100,000 g/mole Mw and is soluble or dispersible in water at room temperature of about 70° F. In the preferred embodiments the polymeric thickening agent has a molecular weight of at least 500,000 and most preferably at least 1,000,000 g/mole Mw to about 10,000,000. The preferred polymer is poly(ethylene oxide) having a molecular weight of at least about 100,000 g/mole Mw, preferably at least 500,000 g/mole Mw and most preferably at least 1,000,000 g/mole Mw. Other suitable polymers may include, for example, polyacrylamides, polypropylene oxide and polyethyleneoxide/polypropylene oxide copolymers which are water soluble and have a molecular weight of at least about 100,000 g/mole Mw. The polymers are preferably linear aliphatic, non-cyclic polymers.

As noted above, the thickening agent (e.g., PEO) is preferably highly linear. Linearity of polymers is difficult to reliably quantify. The high linearity of the preferred thickening agents may be seen at least comparatively by noting that the characteristic ratio of $\overline{r_0^2}/1^2x$ (i.e., ratio of the "unperturbed dimensions"—square of the actual chain dimensions in the absence of long range interactions—$\overline{r_0^2}$ to the square of the random-flight end-to-end distance—$1^2x$) for PEO is abut 4.0 [the lower the number the more linear the polymer], whereas the $\overline{r_0^2}/1^2x$ ratios for other common polymers are, for example: polyethylene—6.7; polystyrene (atactic)—10.0; polypropylene (isotactic)—5.7; and 66-Nylon—5.9 [see, Billmeyer, F. W. *Textbook of Polymer Science*, 1984, pp. 157–159—which is hereby incorporated by reference].

A preferred commercially available poly(ethylene oxide) suitable for practicing the invention is sold under the trade name POLYOX (e.g., grade WSR-301) by Union Carbide Co. POLYOX provides a nonionic water-soluble polymer having a degree of polymerization, n, varying from about 2,000 to about 180,000 (depending on viscosity grade). POLYOX has the structure of: $-(OCH_2CH_2)_n-OH$. POLYOX grade WSR-301 has a molecular weight of approximately 4,000,000 g/mole (based on rheological measurements). A 1% (weight percent) aqueous solution of POLYOX WSR-301 at 25° C. has a viscosity of 1650–5500 mPa.sec (cP) (using a Brookfield Viscometer Model RVF, spindle no. 2, at 2 rpm). This poly(ethylene oxide) is sold as 99% actives.

It has been found that addition of PEO in the previously mentioned coating formulations results in improved coating pickup by the paper (or other material) to which the coating is applied—i.e., improved deposition efficiency, allowing previously unobtainable coating weights to be achieved under standard coater operating conditions. In many applications, this increase in coating weights has eliminated the need for a second coating pass or any precoating treatment. Furthermore, the addition of PEO in these standard coating formulations has resulted in improved surface properties such as sheet gloss, smoothness and fiber coverage.

It is surprising that these improvements occur, based on the rheology properties of the PEO/binder or PEO/binder/pigment coatings. Typically, these coatings have a very low Brookfield viscosity and would not be expected to provide sufficient fiber coverage, coating machine operability, and coating pickup for the paper surface improvements mentioned above. Other coatings with similar viscosities, but utilizing traditional rheology modifiers, do not provide the aforementioned paper improvements. For example, as discussed hereinafter, a PEO-based coating having a Brookfield viscosity of 1440 cps has proven to perform well as a paper coating whereas, for example, a polyoxyalkylene-based coating of similar viscosity would likely be plagued by lower gloss and lower coat weight under the same application technique. Also, it is not necessary to use any particular/specialized coating method to obtain these benefits of the inventive coating and these properties are not jeopardized when the inventive PEO-based coating is combined with other paper coatings.

EXAMPLES:

The inventive coating may be better understood through review of the following non-limiting examples.

1. Coat Weight

Laboratory work has shown that using PEO as a rheology modifier allows for higher coating weights to be applied at normal coater operating conditions. The advantages of this are that for certain applications it is desirable to have high coating weights, for improved fiber coverage and surface properties. In the past, to achieve higher than normal coating weights it was necessary to modify the coating formula by adding an abundance of thickener and raising the viscosity of the coating. This has the detrimental effect of changing the surface properties of the coated paper. A second approach to achieving higher coat weights is to apply coating on two separate coating passes or coating stations. This of course increases the manufacturing cost for a given grade of paper or equipment and can also be detrimental to the roll quality of the paper because of the multiple passes.

PEO is a coating tool that allows for higher coat weights to be obtained using a standard coating formulation and standard coater operating conditions. Two identical coating formulas were prepared. Major ingredients contained in both coatings included clay pigments, styrene butadiene binder (e.g., 0–12% by weight), and polyvinyl acetate binder (e.g., 5–18% by weight). [These weights are based on dry weights and are relative to the weight of the clay pigments—i.e., with a coating having 100 parts clay, 0–12 parts by weight of styrene butadiene binder and 5 to 18 parts by weight polyvinyl acetate binder would be used]. The only difference in the two coatings was the rheology modifier used. In one coating 0.2% (based on dry weight of the clay pigments) of PEO was added to the coating. In the second coating, 0.6% of CMC/acrylate ("CMC" signifies carboxymethylcellulose) was used as the thickner. The Brookfield viscosity of the PEO coating was 1440 cps. and the high shear viscosity was 155.7 cps. The Brookfield Viscosity was measured with a #5 spindle at 50 rpm at 72°–74° F. using the procedure described in ASTM (D 2196) Bulletin No. 06.01. The high shear viscosity ("Hercules" viscosity) was measured with 2100 reciprocal secs with 400,000 dynes.cm/cm at 72°–74° F. using the procedure of TAPPI T-648 OM-88. [These same procedures were used to measure the BV and HV viscosities described hereinafter.] For the coating thickened with CMC/acrylate, a Brookfield viscosity of 4240 cps., and a high shear viscosity of 171.7 cps. was recorded.

Both coatings were applied to a common basestock on a laboratory coater [a blade coater was used but it is believed that other coater machinery would produce correspondingly comparable/analogous coat weights]. Coating was applied at a constant coater speed at a constant blade pressure. The coat weights for the two coatings are listed below [the coat weights were measured gravimetrically—i.e., dry paper was measured both before and after coating].

(a) CMC/Acrylate

| Rheology Modifier | Sample | Coater Speed | Air Pressure (on blade) | Coat Weight (in pounds per ream) |
|---|---|---|---|---|
| CMC/Acrylate | 1 | 235 fpm | 23 psi | 8.1 #/rm |
| " | 2 | 235 fpm | 23 psi | 8.3 #/rm |
| " | 3 | 235 fpm | 23 psi | 7.9 #/rm |
| " | 4 | 235 fpm | 23 psi | 8.3 #/rm |
| " | 5 | 235 fpm | 23 psi | 7.9 #/rm |

Brookfield Viscosity ("BV")–measured with #5 spindle @ 50 rpm @ 72–74° F. = 4240 cps
High Shear Viscosity ("HV")–measured with 2100 reciprocal secs with load setting of 400,000 dynes•cm/cm @ 72–74° F. = 171.1 cps The average matte gloss of the five samples was 25.9 with a PPS smoothness of 3.3 microns (PPS was measured using a Parker Print Surf surface analyzer using the British Standard Method No. B 56563). The average enamel gloss of the five samples was 74.7 with a PPS smoothness of 1.1 microns. The matte and enamel glosses of the samples were measured with a 75 degree Gardner Glossmeter—this method/equipment was also used with the gloss readings described hereinafter.

(b) Poly(ethylene oxide)–PEO

| Rheology Modifier | Sample | Coater Speed | Air Pressure (on blade) | Coat Weight (in pounds per ream) |
|---|---|---|---|---|
| PEO | 1 | 235 fpm | 23 psi | 14.7 #/rm |
| " | 2 | 235 fpm | 23 psi | 15.4 #/rm |
| " | 3 | 235 fpm | 23 psi | 15.2 #/rm |

-continued

| (b) Poly(ethylene oxide)--PEO | | | | |
|---|---|---|---|---|
| Rheology Modifier | Sample | Coater Speed | Air Pressure (on blade) | Coat Weight (in pounds per ream) |
| " | 4 | 235 fpm | 23 psi | 15.1 #/rm |
| " | 5 | 235 fpm | 23 psi | 14.9 #/rm |

BV-#5 spindle @ 50 rpm @ 72-74° F. = 1440 cps
HV-2100 reciprocal secs with 400,000 dynes•cm/cm @ 72-74° F. = 155.7 cps The average matte gloss of the five samples was 37.3 with a PPS smoothness of 2.8 microns. The average enamel gloss of the five samples was 79.0 with a PPS of 0.9 microns.

2. Gloss

Laboratory work has indicated that the use of PEO as a rheology control additive provides a coated paper gloss higher than that provided when using identical coating weights and compositions containing other, conventional, rheology modifiers (e.g., such as CMC and/or polyacrylate thickeners). In this example, various coating compositions were used while changing only the rheology agent for direct comparison. Major ingredients contained in all formulations included clay pigments, styrene butadiene binder, and polyvinyl acetate binder. A common 52 pounds per ream (i.e., 3300 sq. ft.) paper was used for lab coating work. A coat weight of 8.5±0.5 lbs./ream was applied by a blade coater (it is believed that equivalent results would also be achieved with drawdowns on a coater—i.e., the coating method used does not appear to be important to the present invention). It is believed that this is about an average coat weight using conventional methods, equipment and coating compositions. Gloss readings were then taken with a 75 degree Gardner gloss meter on the paper as coated and dried (matte) and on the same paper after supercalendering (enamel). The average readings of five sheets are shown in the table below [the gloss readings provide a measure of the percent reflectance—i.e., of incident light—provided by the respective samples].

| Composition | Rheology Modifier | Matte Gloss | Enamel Gloss |
|---|---|---|---|
| 1 | PEO | 24.1 | 78.2 |
| 1 | CMC/Acrylate | 18.5 | 73.8 |
| 2 | PEO | 23.9 | 75.9 |
| 2 | CMC/Acrylate | 20.0 | 70.3 |
| 3 | PEO | 24.4 | 76.7 |
| 3 | CMC/Acrylate | 21.6 | 73.2 |

3. Smoothness

In a similar study, two coatings were prepared with identical amounts of clay pigment, SBR (styrene butadiene) binder and PVAC (polyvinyl alcohol) binder. One coating utilized CMC (carboxymethylcellulose), a typical rheology modifier for paper coatings. The second coating was prepared with an equal amount of PEO. The coatings were applied to a standard 52# (lbs.) base sheet with a blade coater. The coatings were applied at three different levels of coat weight. The sheets were then tested for 75 degree Gardner gloss after coating (matte) and after supercalendering (enamel). The enamel sheets were also tested for surface smoothness using the Parker Print Surf (PPS) test (using British Standard Method No. B56563—the lower the values, the smoother the surface). The results are listed in the following table.

| Thickener | Cwt (lbs/ 3300 ft$^2$) | Matte Gloss | Enamel Gloss | PPS (Microns) |
|---|---|---|---|---|
| CMC | 9.5 | 15.8 | 70.3 | 1.3 |
| CMC | 11.0 | 14.9 | 72.5 | 1.2 |
| CMC | 12.0 | 14.2 | 72.5 | 1.3 |
| PEO | 9.5 | 19.0 | 76.8 | 1.1 |
| PEO | 11.0 | 21.6 | 77.1 | 1.1 |
| PEO | 12.0 | 19.4 | 77.7 | 1.1 |

It is evident from these examples that higher coat weights were more readily obtained with the coatings containing PEO as a rheology modifier. Higher coat weights provide ancillary gloss and smoothness benefits. Furthermore, the coatings containing PEO provided a glossier and smoother paper surface at a given coat weight than the coatings containing other thickeners. Also, scanning electron microscopy photographs indicate improved fiber coverage and coating smoothness on the sheets coated with a PEO thickened coating.

It will be understood that while the invention has been described in terms of and with the aid of many illustrative examples, numerous changes in details, proportions, ingredients, and the like may be made within the broad scope of the invention, as defined by the claims which follow.

What is claimed is:

1. In a process for coating paper or paperboard by applying to the surface of said paper or paperboard on a high speed paper coater a composition comprising, water, at least one natural pigment, a binder in an amount of about 1 to about 30 dry weight percent of said pigment, and a rheological modifier imparting viscosity properties to said composition to enable it to be applied to paper or paperboard by high speed coater, the improvement permitting the application of coat weights of at least about 8 pounds of dry composition per ream per run per side while maintaining high matte gloss and smoothness in the resulting coated product comprising, using as rheological modifier in said composition poly(ethylene oxide) having a molecular weight of at least 500,000 in an amount of 0.001 to 10 dry weight percent of said pigments.

2. Process as claimed in claim 1 wherein said coating composition further comprises other minor additives such as defoamers, biocides, dyes, and/or insolubilizers.

3. Process as claimed in claim 1 wherein said coating is applied by a blade or rod coater, and is applied either on a paper machine or on a stand-alone coater.

4. Process as claimed in claim 1 in which the composition also contains any combination of thickeners from the group consisting of: cellulosic thickeners, water soluble alginate thickeners, polyacrylate thickeners and modified and/or converted starches.

5. Process as claimed in claim 1 wherein said poly(ethylene oxide) has a molecular weight of at least 1,000,000 up to about 10,000,000.

6. Process as claimed in claim 1 wherein said composition is applied in an amount of at least about 14 pounds of dry composition per ream per run per side.

7. Process as claimed in claim 1 providing a coated product having an ultra high coat weight of about 10 to about 20 pounds of dry composition per ream per run per side.

8. In a coated paper or paperboard having a coating comprising at least one natural pigment, a binder in an amount of about 1 to about 30 dry weight percent of said pigment and a rheological modifier imparting high and low shear viscosity properties to said composition to enable it to be applied to paper or paperboard by high speed coaters, the improvement providing said paper or paperboard with a coating weight of at least 8 pounds per ream per run per side on a dry basis of a composition and having a high matte gloss and smoothness, comprising the inclusion as rheological modifier poly(ethylene oxide) having a molecular weight of at least 500,000 in an amount of about 0.001 to about 10 dry weight percent of said pigments.

9. Coated paper or paperboard as claimed in claim 8 wherein said poly(ethylene oxide) has a molecular weight of at least 1,000,000 up to about 10,000,000.

10. Coated paper or paperboard as claimed in claim 8 providing a coated product having an ultra high coat weight of about 10 to about 20 pounds of dry composition per ream per run per side.

11. Coated paper or paperboard as claimed in claim 8 wherein said paper product includes at least about 10 lbs. of said dry composition per ream of paper per run side.

12. Coated paper or paperboard as claimed in claim 8 wherein said paper product has a matte gloss of at least about 20 and an enamel gloss of at least about 75.

13. Coated paper or paperboard claimed in claim 8 wherein said paper product has a Parker Print Surf reading of about 1.1 microns or below.

* * * * *